United States Patent [19]

Pechamat et al.

[11] 4,167,888

[45] Sep. 18, 1979

[54] AUTOMATIC FIREARMS WITH EXTERNAL MOTOR

[75] Inventors: Jacques M. Pechamat; Joël M. Marcon, both of Bourges; Georges H. Simon, St. Germain du Puy, all of France

[73] Assignee: Etat Francais, as represented by Delegue General pour l'Armement, Paris, France

[21] Appl. No.: 854,674

[22] Filed: Nov. 25, 1977

[30] Foreign Application Priority Data

Nov. 26, 1976 [FR] France ..... 76 35638

[51] Int. Cl.[2] ..... F41D 7/02

[52] U.S. Cl. ..... 89/11; 89/185

[58] Field of Search ..... 89/11, 9, 7, 185

[56] References Cited

U.S. PATENT DOCUMENTS

| | | | |
|---|---|---|---|
| 563,701 | 7/1896 | Wilder | 89/11 |
| 1,749,137 | 3/1930 | Hudson | 89/11 X |
| 3,181,423 | 5/1965 | Rocha | 89/9 UX |
| 3,241,448 | 3/1966 | Rocha | 89/11 |
| 3,327,587 | 6/1967 | Reed et al. | 89/9 X |
| 3,548,709 | 12/1970 | Prince | 89/9 X |
| 3,648,561 | 3/1972 | Stoner | 89/11 |
| 3,868,884 | 3/1975 | Rose et al. | 89/11 |
| 4,062,266 | 12/1977 | Elmore et al. | 89/7 |
| 4,065,998 | 1/1978 | Rocha | 89/11 |

*Primary Examiner*—David H. Brown

*Attorney, Agent, or Firm*—Stevens, Davis, Miller & Mosher

[57] ABSTRACT

This disclosure relates to an automatic firearms having a rotatable drum with helical grooves therein so arranged as to cause a follower guided by said grooves to reciprocate at a speed proportional to the rotational speed of the drum. The reciprocation of the follower causes the breech mechanism to reciprocate between loading and firing positions. The drum is driven by means independent of the propulsion energy of the projectiles fired, and therefore, may be operated at varying speeds by means such as an electric motor or even by hand.

7 Claims, 7 Drawing Figures

AUTOMATIC FIREARMS WITH EXTERNAL MOTOR

This invention relates to automatic firearms which comprise a barrel whose axis is fixed with respect to a breech mechanism casing; a cartridge chamber which is limited at the rear of the barrel by a breech mechanism; a rotary drum whose side surface bears a helicoidal drive ramp of closed contour; a follower member which cooperates with said ramp and which is rigidly fastened to one of the two parts formed of the barrel and the breech mechanism, which part is guided in translation by the breech casing parallel to the said axis; and an outer motor capable of causing the drum to turn in a constant direction around an axis parallel to that of the barrel, the ramp comprising two oppositely inclined segments which assure the advance and the recoil respectively of the part moving in translation and which are connected on the one side by a non-inclined portion which assures the locking of said moving part during the period of time corresponding to the duration of the shot and the emptying of the gases and on the other side by a portion which corresponds to the feed. The outer motor is an electric motor, but it may also be a hydraulic, pneumatic, or otherwise actuated.

In the case of a double feed associated with the breech mechanism system, one of the methods of changing the direction of feed consists of reversing the rotation of the motor, which is made possible by the symmetry of the ramp. In this case also, nevertheless, one may say that, for each of the two possibilities of feed, the outer motor causes the drum to turn "in a constant direction, " by way of contrast to an alternating movement.

Upon each operating cycle of the firearm the motor causes the drum or rotor to turn in such a manner that the follower member moves once around the closed contour of the ramp and thus closes and opens the cartridge chamber.

Due to the separating of the "fire" and "automatic" functions, firearms of this type permit, on the one hand, greater possibilities of use (possiblity of continuous variation of the rate of fire, use of ammunition of very different ballistic characteristics, etc.) and on the other hand have appreciable economic advantages, due to their long life as well as their adjustment upon the extension of the principle to ammunition different from the original ammunition. Such a weapon may have a life which is three to five times longer than that of a conventional weapon with internal source of energy (in rush of gas, recoil as a result of momentum). These advantages are due in great part to the elimination of the impacts which form the basis of the principle of operation of weapons having an internal source of energy.

A weapon of the type defined in the preamble has been described, in particular, in U.S. Pat. No. 3,241,448, (J. G. Rocha). According to said patent, it is the barrel which bears the follower member which cooperates with the drive ramp and which is thus imparted a movement of alternating translation (reciprocation) with respect to a stationary breech mechanism. This barrel must, therefore, be particularly light, and accordingly the weapon is able to receive only ammunition of a small specific power. Despite everything, the mass subjected to the reciprocating movement always remains relatively large and therefore the entire mechanism (connecting pieces, drum, electric motor driving the drum) must be dimensioned accordingly. Furthermore, the drum has a large diameter and therefore has a high momentum, which is furthermore necessary for the displacement of the large weight of the barrel. Therefore the times for the placing in rotation of the system must be relatively long and the reaching of the firing rate must be rather slow, unless the motor is over-powerful in permanent operation or relatively low rates are acceptable. Summarizing the weapon described in the patent in question can use only ammunition of small specific power and has rather reduced performances from the standpoint of automaticity (rate, time of acceleration, time of deceleration). Furthermore, the high momentum of the barrel makes it necessary for the drive ramp of the drum to have an inclination which varies practically continuously in order to assure progressive acceleration and deceleration of the barrel, which makes the machining of said ramp difficult.

In order to eliminate these drawbacks, the weapon in accordance with the present invention is essentially characterized by the fact that the part which bears the follower member and is thus imparted a movement of alternate translation is the breech mechanism and that therefore, the drive ramp has a constant inclination over the major part of each of the two segments referred to above. Therefore, in accordance with the invention, the part movable in translation is not the barrel but a self-locking breech mechanism which assures the introduction of the ammunition and the closing of the cartridge chamber, and therefore the mass referred to the specific power of the ammunition is particularly low, since one can evaluate it at about 1/30th of the weight of the barrel. The moving mass being therefore particularly small, it follows on the one hand that the stresses are slight and that the mechanism as a whole may be dimensioned accordingly and, on the other hand, that one can cut the drive ramp in such a manner that it is of constant inclination over the major part of its two segments which assure the advance and recoil respectively of the movable breech. As a matter of fact, the rest of the ramp is sufficient to cause the acceleration and deceleration of the breech without giving rise to excessive stresses. It is clear that the shape thus imparted to the ramp facilitates its machining and therefore decreases the cost price of the mechanism.

It should be noted that in U.S. Pat. No. 1,216,938 (Brotherstone) it has already been proposed to use an electric motor to impart to a moving breech mechanism an alternating movement of translation, but the transmission by connecting-rod and crank which is interposed between the motor and the movable breech mechanism is not sufficiently reliable to permit high speeds and does not make it possible to master the law of movement of the breech mechanism towards the ends of its forward and rearward stroke, contrary to a transmission which comprises a rotary drum with helicoidal ramp.

By contrast, according to the present invention, the constant angle of inclination of the drive ramp is preferably on the order of 45°, with respect to the axis of the drum. In accordance with one preferred construction of the present invention, the drive ramp extends over n revolutions of the drum, in which n is at least equal to 3 and preferably equal to 4, and the portions of constant inclination of the ramp cover the n-1 intersections of the two segments of the ramp.

It should be noted that, in accordance with the aforementioned U.S. Pat. No. 3,241,448, a control ramp has already been provided which extends over three revolutions of the drum and which therefore comprises two intersections. However, for the reasons set forth above, one of the intersections takes place at 90°, while the other takes place along an acute angle. On the other hand, in accordance with the present invention, the intersections all take place at the same angle, which is preferably close to 90°.

As has been explained in the aforementioned U.S. Pat. No. 3,241,448, the presence of intersections on the helicoidal ramp may well result in malfunctioning, due to the fact that different paths, one good and two bad, offer themselves to the follower member upon the passage of each intersection. In order to eliminate this difficulty, this patent proposes having one and the same shaft bear a follow-up member formed of a roller and a guide member formed of an elongated shoe, which slides within a double groove forming the ramp on the inner surface of the drum. The presence of the double groove complicates the machining. Furthermore, the said shoe produces resistance by rubbing, and accordingly heating. Finally, due to its elongated shape, the shoe fits only with difficulty in a double groove of winding shape.

In order to eliminate the said difficulty, the invention utilizes the fact that all the intersections are present on portions of the ramp which are of constant inclination.

For this purpose, in the weapon in accordance with the invention, the follower member is formed of a roller which is associated with a guide roller; the two rollers are engaged in a groove which is provided on the outer surface of the drum and constitutes the ramp, and they are borne by a plate which is mounted on the breech mechanism in such a manner that it can turn with respect to the latter around an axis parallel to that of the two rollers; said plate has at least two flat guide surfaces which cooperate alternatively with at least one flat guide surface borne by the breech casing; and this latter guide surface is arranged parallel to the axis of the barrel and extends over an axial zone of the drum which is shorter than that in which the portions of constant inclination of the two segments of its ramps are located, but so determined as to cover all the intersections of the ramp.

In this way, the guide surface of the breech mechanism casing imposes a variable orientation on the turning plate on the portions of the two segments of the ramp which cover the intersections, and which are of constant inclination. The follower roller is thus held on the proper bath by the guide roller upon passage of the intersections. At its ends, the ramp no longer has an intersection, and the follower and guide rollers therefore follow its contour without difficulty and thus at any moment determine the angular position of the turning plate which is then freed by the guide surface from the breech mechanism casing. Just before one of the two guide surfaces of the turning plate arrives again in the zone of action of the guide surface of the breech mechanism casing, the two rollers impose upon the turning plate the orientation necessary in order that the guide surfaces of the turning plate and of the breech mechanism casing can again slide on each other. Due to the fact that the switch system in accordance with the invention requires only the rolling of rollers or the sliding of flat surfaces on each other, it produces, in operation, only minimum resistances and heating.

The invention will be described in further detail below with reference to the accompanying drawings which illustrate a preferred embodiment thereof.

Figure 2:
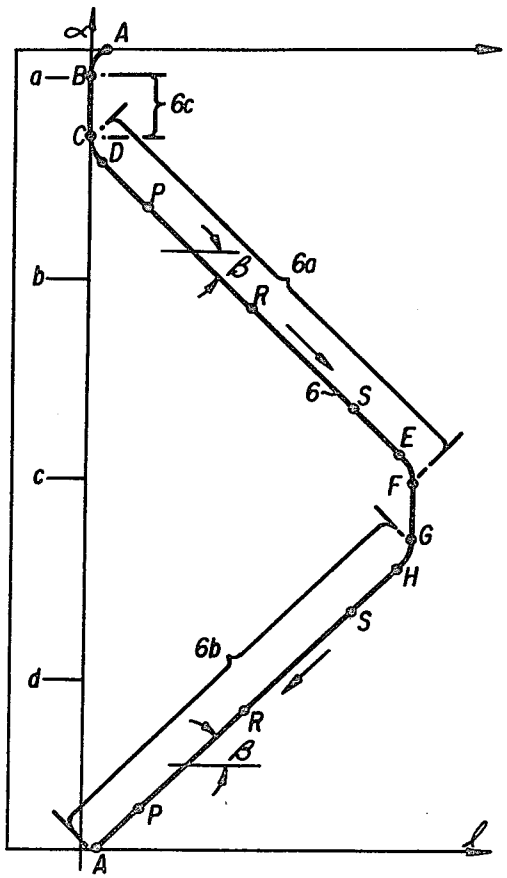
FIGS. 2 and 3 show, on different scales, a developed view of the drive ramp borne by the drum.

The automatic firearm in accordance with the invention comprises a barrel 1 (FIG. 1) whose axis X—X is fixed with respect to a breech casing 2 (see FIG. 4); a cartridge chamber 3 which is limited towards the rear of the barrel 1 by a breech mechanism 4; a rotary drum whose lateral surface bears a helicoidal drive ramp 6 of closed contour; a follower member 7 (see FIG. 4) which cooperates with said ramp and which is firmly connected with one of the parts consisting of the barrel 1 and the breech mechanism 4, said part being guided in translation by the breech mechanism casing 2 parallel to the axis X—X; and an outer motor 8 capable of turning the drum 5 in a constant direction (as defined in the preamble to the specification) around an axis Y—Y parallel to the axis X—X of the barrel 1. The ramp 6 comprises two segments inclined in opposite directions, *6a* and *6b*, which assure the recoil and advance respectively of the part movable in translation and which are connected at one side by a non-inclined portion *6c* assuring the locking of said moving parts during the period of time corresponding to the duration of the firing and the emptying of the gases. The motor 8 is generally an electric motor which is fed via the fire trigger switch (not shown) and the speed of which can be adjusted so as to vary the rate of fire.

In accordance with the present invention, the part which bears the follower member 7 and to which is thus imparted a movement of alternate translation (reciprocation) is the breech mechanism 4. The drive ramp 6 has a constant inclination over the major part of the segments *6a* and *6b*. It is the movable breech mechanism 4 which assures the transfer of the ammunition 9 which is fixed in the breech mechanism head 10.

The shape thus imparted to the ramp 6 is illustrated on a larger scale by the curve of FIG. 2 in which there has been entered on the abscissa the longitudinal stroke l of the moving breech mechanism 4 (in accordance with the arrangement of FIG. 1) and on the ordinates the angular distance $\alpha$ transversed by any point of the drum 5 during each operating cycle.

The start of the cycle, represented at the point A, corresponds to the end of the locking of the breech mechanism head 10 and the ignition of the primer of the ammunition 9. The portion of the curve AB corresponds to the deceleration of the breech mechanism 4 in its forward movement (towards the left in FIG. 1). The straight line segment BC represents the uninclined portion *6c* of the ramp. The curved portion CD corresponds to the acceleration of the breech 4 in its rearward movement. The duration of the firing is covered by the time of rotation which corresponds substantially to the ramp segment AD. The curved portions EF and GH correspond to the deceleration of the breech mechanism 4 in its rearward movement and to its acceleration in its forward movement respectively. The straight-line segment FG represents the time of halt of the movable breech mechanism 4 in rear position, during which time the ejection of the shell of the ammunition fired is effected as well as the putting in place of new ammunition on the breech mechanism head 10. In accordance with the invention, the segment 6*a* has a constant inclination over the major part DE of its length (movement of the breech mechanism 4 at a constant speed towards the rear) and the segment 6*b* has a constant inclination over the major part HA of its length (movement of the breech mechanism 4 at constant speed towards the front). The angle of inclination $\beta$ of the portions DE and HA is preferably on the order of 45° referred to the axis X—X.

Figure 1:
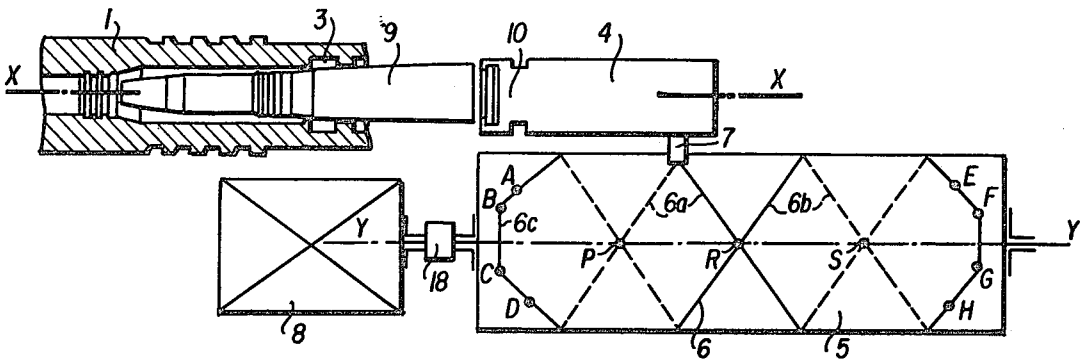
FIG. 1 shows the basic principle of the installation.
Figure 3:
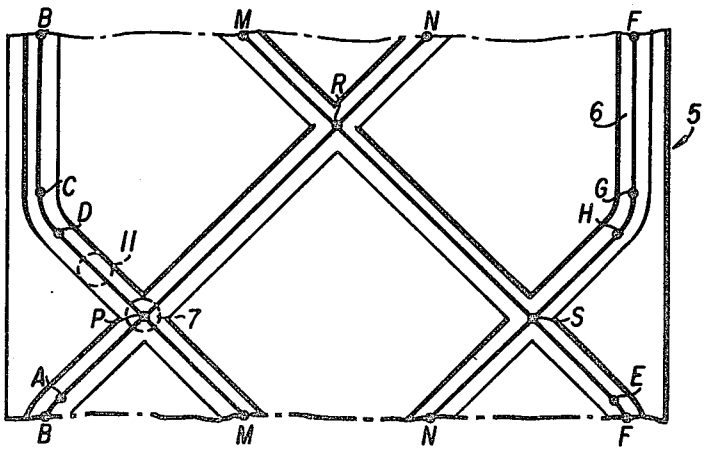
Figure 4:
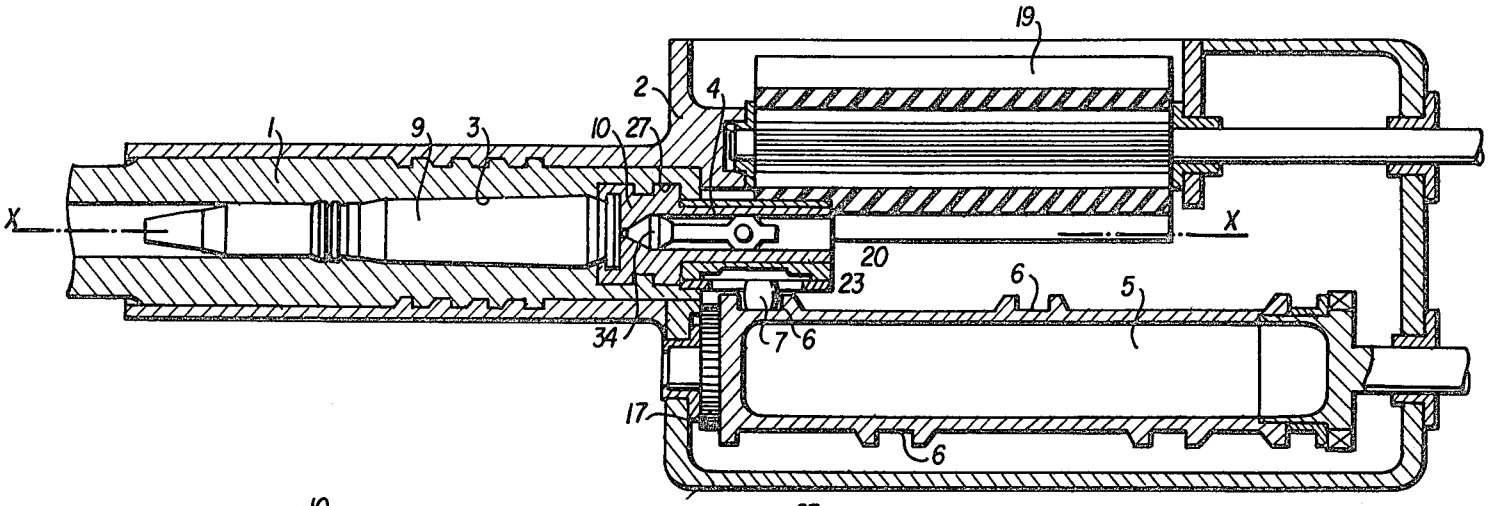
FIG. 4 shows, in section through a plane passing through the axis of the barrel, the rear of the barrel, the movable breech mechanism and its drive drum.

In accordance with one advantageous construction, the drive ramp 6 extends over n revolutions of the drum 5, in which n is a number equal to at least 3, and the portions of constant inclination of the segments 6*a* and 6*b* of the ramp 6 cover the n−1 intersections of these two segments. In particular, according to the preferred embodiment of the invention which is illustrated in FIGS. 1, 3 and 4, the ramp extends over four revolutions of the drum 5 and comprises three intersections P, R and S. FIG. 3 is a developed view of the outer surface of the drum 5 in plan view. For this, the cylindrical outer surface of the drum 5 has been cut by a half plane passing through the axis Y—Y and developed on the plane of FIG. 3, the trace of this half plane being represented by the two horizontal dash-dot lines which limit FIG. 3 at the top and at the bottom. In other words, it can be considered that the ramp 6 has been traced in FIG. 3 with the same abscissa as in FIG. 2 (horizontal stroke of the movable breech mechanism 4). As to the ordinate of FIG. 3, it can be deduced easily from that of FIG. 2. As a matter of fact, it is merely necessary to divide the curve of FIG. 2 into four equal horizontal sections which correspond to the successive revolutions of the drum 5 and to transfer each of these four sections between the two horizontal dot-dash lines in FIG. 3. By way of indication, the limits of the sections have been indicated at a, b, c and d in FIG. 2. A similar correlation could be established between FIGS. 2 and 3 in the event that the number n of revolutions were equal, for instance, to three or five. It should be noted that FIG. 3 also differs from FIG. 2 by the fact that the limits of the groove forming the ramp 6 have been added to it.

It will be understood that at the intersections P, R and S the follower member 7 is offered three different paths. In order to remove the indeterminacy with respect to the passage of these intersections, the follower member 7 is formed by a roller which is associated with a guide roller 11. The two rollers 7 and 11 are engaged in the groove which is provided on the outer surface of the drum 5 and the profile of which can be noted from FIG. 4 and these rollers are borne by a plate 12 which is mounted on the breech mechanism 4 in such a manner that it can turn with respect to the latter around an axis parallel to the axes of the two rollers 7 and 11, these three axes being vertical in FIG. 5 and perpendicular to the plane of FIG. 6. The turning plate 12 comprises a first set of two parallel guide surfaces 13 and a second set of two parallel guide surfaces 14 which cooperate alternately with two flat surfaces 15 borne by the breech casing 2. The guide surfaces 15 are arranged parallel to the axis X—X of the barrel 1 and extend over an axial zone of the drum 5 which is shorter than that in which the portions of constant inclination of the two segments 6*a*, 6*b* of the ramp 6 are located but so determined as to cover all the intersections P, R, S of the ramp. When the angle of inclination $\beta$ is equal to 45°, the surfaces 13 and 14 are perpendicular in pairs, so that the part 12 has, at their level, a square profile which can be seen in FIG. 6; if this angle is other than 45°, this profile has the shape of a diamond.

FIGS. 4 to 7 show details of construction of the preferred embodiment of the invention.

FIG. 4 shows a section through the breech mechanism in forward position; this is the position in which the breech mechanism 4 is locked on the barrel 1 at the time of ignition. Within the breech casing 2 bearing the barrel 1, the breech mechanism 4 is driven in a reciprocating movement and the drum 5 is driven in a movement of rotation. This drum is rigidly connected with a pinion 17 which forms part of a gear train 18 (FIG. 1) which connects the shaft of the motor 8 to the drum 5. At the rear end of this drum 5 (on the right-hand side of FIG. 4), a mechanism (not shown) permits the driving of the ammunition feeding system and, in particular, of a feed and ejection spider 19 (see also FIG. 7).

Figure 5:
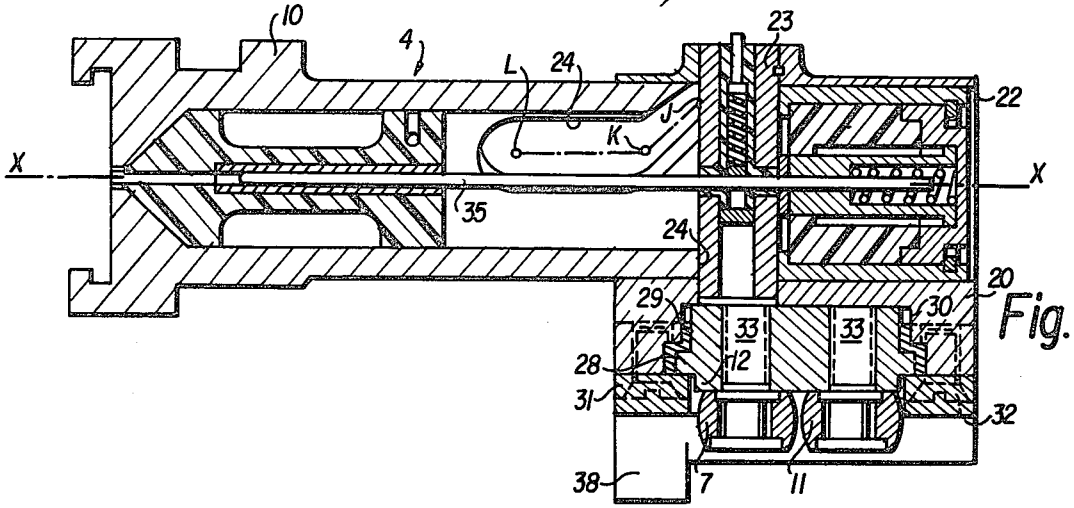
FIG. 5 represents to an enlarged scale a mobile breech mechanism and its roller carriers in section by a view perpendicular to that of FIG. 4.
Figure 7:
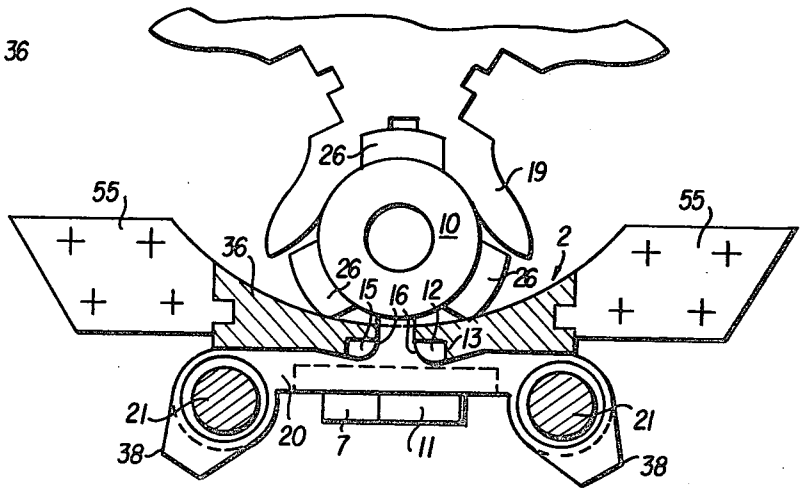
FIG. 7 shows a vertical section taken on the axis of the barrel of the breech mechanism and its rollers.
Figure 6:
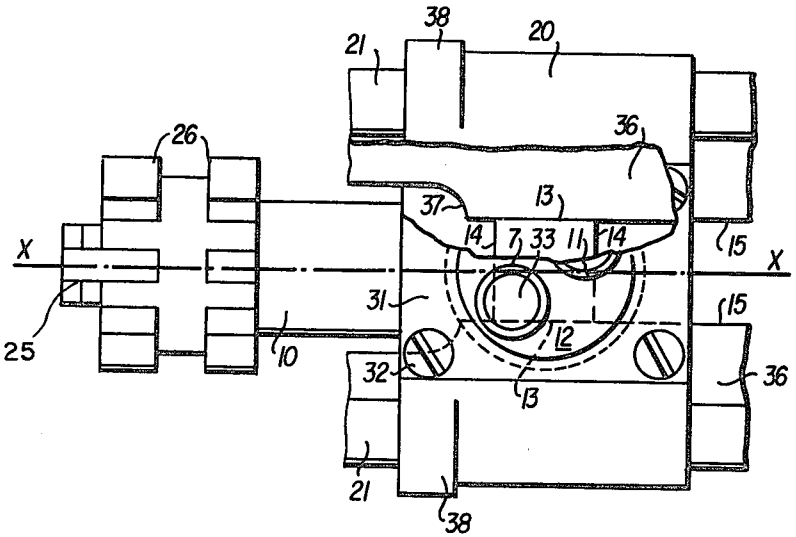
FIG. 6 shows a bottom view of FIG. 5 with parts in section.

The movable breech mechanism 4 is formed of the breech head 10 and of an operating part 20 (see also FIGS. 5, 6 and 7). The operating part 20 is guided by two rods 21 (FIGS. 6 and 7), which are rigidly connected with the breech casing 2 and arranged parallel to the axis X—X. This part 20 is provided with a borehole 22 (FIG. 5) in which the breech head 10 can turn and bears a transverse finger 23 (see also FIG. 4) which passes through the breech head via two diametrically opposite ramps 24. Each of these ramps 24 comprises a rear segment parallel to the axis X—X (in which segment the finger 23 in FIG. 5 is engaged), a helicoidal intermediate segment JK, and a front segment KL parallel to the axis X—X. FIG. 5 shows the position occupied by the finger 23 and the breech head 10 upon the displacement of the movable breech mechanism in translation. Upon this displacement, the breech head 10 is locked in rotation by engagement of a stud 25 (FIG. 6) in a groove 16 (FIG. 7) parallel to the axis X—X. When the breech head 10 comes against the rear edge of the barrel 1, the operating part 20 continues to advance and the finger first of all describes the helicoidal segment JK which causes the breech head 10 to rotate, its stud 25 having then gone beyond the zone of action of its groove 16. Upon this turning, the breech head 10 is locked, on the rear of the barrel 1, by the penetration of locking teeth 26 (see also FIG. 7) into notches 27 (see FIG. 4) which are provided for this purpose at the rear of the barrel 1. The point K of the ramps of the breech head 10 (FIG. 5) corresponds to the moment of firing at the end of the locking, the segment KL being traversed after the firing. The movements of translation and rotation are reproduced in opposite direction upon the recoil of the movable breech mechanism 4. The firing can be effected either (as illustrated in FIG. 4) by means of a firing pin 34 or (as illustrated in FIG. 5) by means of an insulated central contactor 35, the electric current being fed to said contacter 35 by the shaft of the finger 23.

As shown in FIGS. 5 and 6, the turning plate 12 has the shape of the cylinder of revolution bearing a small annular collar 28 on its outside. This plate is engaged, with the interposition of an antifriction ring 29, in a cylindrical recess 30 provided for this purpose in the part 20 and it is held in this recess by a plate 31 which is fastened by screws 32 to the part 20. The axis of the cylindrical recess 30 is thus identical with the axis of rotation of the rotating plate 12. The latter bears two pivots 33, which are parallel to said axis and on which there are idly mounted the rollers 7 and 11 respectively. As shown in FIG. 7, the operating part 20 is notched laterally towards the top so as to permit the guide surfaces 13 and 14 of the plate 12 to appear and enable them to come in contact with the stationary guide surfaces 15. The latter are provided on floors 36 and terminate, in front and at rear, at clearances 37 (FIG. 6) which permit the rotation of the rotating plate 12, outside the zone of the intersections P, R and S. The floors 36 are part of the recoiling rigid assembly, the stationary part or cradle of the firearm being visible in FIG. 7 at 55.

The automatic weapon which has just been described operates in the following manner. When the person using it acts on the fire trigger switch he causes the feeding of the electric motor 8. Via the gear train 18, the latter rotates the drum 5 and the spider 19. Due to the engagement of the rollers 7, 11 in the groove of the drum 5 which constitutes the ramp 6, the operating part 20 effects a forward and rearward movement along the guide rods 21 each time that the drum 5 turns four revolutions. During this forward and return movement, the sequence of operations corresponding to the cycle A, B, C, D, P (M), R, S, E, F, G, H, S (N), P, A which has been described above takes place, the breech mechanism 4 being in rearward position upon the starting and the stopping. The points M and N are not particular points of the cycle but have each been entered in FIG. 3 both on top and on bottom to indicate the continuity of the two portions of constant inclination of the ramp 6, namely the portions EPRSE and HSRPA. On each of these two portions, the rotating plate 12 is held, by contact of its surfaces 13, or 14 with the stationary guide surfaces 15, in the angular position desired in order that the plane of the axes of the rollers 7, 11 remains inclined by the angle $\beta$ with respect to the axis X—X of the barrel.

Therefore, at each intersection PRS, the roller 7 which first arrives is prevented from moving away from its path and straying off or at least striking a point of the switch. Let us consider, for instance, the position shown in dot-dash line in FIG. 3 where the roller 7 is arriving at the intersection P descending from the left to the right and would therefore be normally free to deviate 90°. However, in accordance with the present invention, the roller 7 is maintained on the proper path by the rotating plate 12, assisted by the roller 11. Likewise, when the roller 11 arrives at the intersection P it is held on the proper path by the rotating plate 12, assisted by the roller 7.

As soon as the rollers 7 and 11 have passed over the last intersection of the sectors **6*a* and 6*b*, the guide surfaces 13 or 14 of the rotating plate 12 arrive at the level of the front or rear clearances 27, so that the plate 12 is free to turn under the combined action of the rollers 7 and 11. The latter can therefore follow the segments EFGH or ABCD of the ramp 6 without encountering an intersection, and then re-engage the guide surfaces 14 or 13 of the rotating plate 12 between the stationary guide surfaces 15**, and so on.

In the foregoing, it has been assumed that the ammunition 9 was of the shell type. It goes without saying that the invention can also apply in the case of ammunition without shell or with combustible shell. It would then be sufficient to adapt the breech head 10 to this latter type of ammunition by incorporating suitable sealing elements in it. By way of illustration, it may also be noted that the weapon which has just been described may advantageously be equipped with a blocking system assuring safety in case of "hangfire," this system acting on teeth 38 (FIGS. 5 to 7) which are integral with the operating part 20.

Whatever the embodiment adopted, one obtains an automatic weapon having the following advantages:

total independence of the firing apparatus and the feed mechanism;

possibility of variable rate of firing by controlling the speed of the motor 8;

control of firing (nominal rate almost instantaneous and rapid stop);

long life of the weapon due to elimination of jolts;

reliability of the system;

decrease in cost of development;

reduction of the weight of the weapon (the drum 5 in particular having a very small weight which can be figure, in non-limitative manner, at 1/25 of the weight of the barrel 1);

less severe action on the ammunition upon the feeding thereof (an advantage which is particularly important in the case of shell-less ammunition);

weapon principle capable of accepting ammunition of very different ballistic properties;

principle easily transposed to variable calibers and different types of ammunition, particularly ammunition with combustible shell and shell-less ammunition;

possibility of operating the weapon in reduced manner, that is to say in case of breakdown or failure of the motor 8 it is possible to turn the drum 5 by hand, which makes firing possible (however with reduced performance).

What is claimed is:

1. Automatic weapon comprising a barrel whose axis is fixed with respect to a breech casing; a cartridge chamber which is limited towards the rear of the barrel by a breech mechanism; a rotary drum whose side surface bears a helicoidal drive ramp of closed contour; a follower member which cooperates with said ramp and which is ridigly connected with the breech mechanism, which breech mechanism is guided in translation by the breech casing parallel to the said axis; and an outer motor capable of causing the drum to turn in a constant direction around an axis parallel to the axis of the barrel, the ramp comprising two segments inclined in opposite directions which assure the advance and recoil respectively of the breech mechanism moving in translation and which are connected on the one end by a non-inclined portion which assures the stopping of said movable part during the period of time corresponding to the duration of the firing and the emptying of the gases and, on the other end, by a portion corresponding to the feeding, characterized by the fact that the drive ramp has a constant inclination over the major part of each of the two segments referred to.

2. Weapon according to claim 1, characterized by the fact that the angle of constant inclination of the drive ramp is on the order of 45° to the axis of the drum.

3. Weapon according to claim 2, characterized by the fact that the two pairs of guide surfaces of the rotating plate define a square profile.

4. Weapon according to claim 1, characterized by the fact that the helicoidal drive ramp extends over n revolutions of the drum, in which n is at least equal to 3 and by the fact that the portions of constant inclination of the ramp cover the n−1 intersections of the two segments of the ramp.

5. Weapon according to claim 1, the follower member being formed of a roller which is associated with a guide roller; the two rollers being engaged in a groove which is provided on the outer surface of the drum and which constitutes the ramp, said rollers being borne by a plate which is mounted on the breech mechanism so as to be able to turn with respect to the latter around an axis parallel to the axes of the two rollers; said plate having at least two flat guide surfaces which cooperates alternately with at least one flat guide surface borne by the breech casing; and said latter guide surface being arranged parallel to the axis of the barrel and extends over an axial zone of the drum which is shorter than that in which the portions of constant inclination of the two segments of the ramp are located but so determined as to cover all the intersections of the ramp.

6. Weapon according to claim 5, characterized by the fact that the rotating plate comprises two pairs of flat guide surfaces, which alternately cooperate with two flat guide surfaces on the breech casing.

7. Weapon according to claim 6, characterized by the fact that the two pairs of guide surfaces of the rotating plate define a square profile.

* * * * *